US006253376B1

(12) United States Patent
Ritter

(10) Patent No.: US 6,253,376 B1
(45) Date of Patent: Jul. 3, 2001

(54) KNEE PAD

(76) Inventor: Frank L. Ritter, 5341 N. Cogswell Rd., El Monte, CA (US) 91732

( * ) Notice: Subject to any disclaimer, the term of this patent is extended or adjusted under 35 U.S.C. 154(b) by 0 days.

(21) Appl. No.: 09/583,750

(22) Filed: May 31, 2000

Related U.S. Application Data

(60) Provisional application No. 60/137,481, filed on Jun. 4, 1999.

(51) Int. Cl.[7] ..... A41D 13/06

(52) U.S. Cl. ..... 2/24; 2/911; 602/26

(58) Field of Search ..... 2/24, 22, 16, 455, 2/911, 413, 908, DIG. 3, DIG. 10; 128/878, 881, 882; 602/23, 26, 62

(56) References Cited

U.S. PATENT DOCUMENTS

| | | | | |
|---|---|---|---|---|
| 871,760 | * | 11/1907 | Long | 2/24 |
| 1,726,939 | * | 9/1929 | Anderson | 2/24 |
| 1,792,048 | | 2/1931 | Svenson . | |
| 3,784,985 | * | 1/1974 | Conroy | 2/22 |
| 4,067,063 | * | 1/1978 | Etinger | 2/455 |
| 4,453,271 | * | 6/1984 | Donzis | 2/455 |
| 4,872,448 | | 10/1989 | Johnson, Jr. . | |
| 5,105,473 | * | 4/1992 | Valtakari | 2/455 |
| 5,255,391 | * | 10/1993 | Levine | 2/24 |
| 5,383,843 | | 1/1995 | Watson et al. . | |
| 5,500,955 | | 3/1996 | Gongea . | |
| 5,524,292 | | 6/1996 | Hargens . | |
| 5,727,252 | | 3/1998 | Oetting et al. . | |
| 6,029,273 | * | 2/2000 | McCrane | 2/24 |
| 6,058,505 | * | 5/2000 | Bettencourt | 2/24 |
| 6,098,208 | * | 8/2000 | Cordon | 2/455 |
| 6,131,196 | * | 10/2000 | Vallion | 2/24 |

FOREIGN PATENT DOCUMENTS

| | | |
|---|---|---|
| 4031358 | 4/1992 | (DE) . |
| 4200056 | 7/1993 | (DE) . |

* cited by examiner

*Primary Examiner*—John J. Calvert
*Assistant Examiner*—Tejash Patel
(74) *Attorney, Agent, or Firm*—Richard C. Litman

(57) ABSTRACT

A knee pad is disclosed for cushioning a human knee. The knee pad includes a cushion section having a fluid-filled chamber. The fluid chamber is filled with a gas, a liquid, a gel, or another fluid. A knee cup is removably attached to the outer layer of the cushion section. The knee cup is interchangeable, so that a knee cup of an appropriate material may be attached for the particular activity the wearer is engaged in. The knee pad is held on the knee by at least one fastening strap. Each fastening strap is removably attached to the cushion section, so that it may easily be replaced when worn out. The invention also includes a knee pad set having two or more interchangeable knee cups for various construction jobs and/or sports.

17 Claims, 8 Drawing Sheets

KNEE PAD

CROSS-REFERENCE TO RELATED APPLICATION

This application claims the benefit of U.S. Provisional Patent Application Serial No. 60/137,481, filed Jun. 4, 1999.

BACKGROUND OF THE INVENTION

1. Field of the Invention

The present invention relates to knee pads.

2. Description of Related Art

Knee pads are well known for protecting the knees while working or while playing sports. One common type of knee pad for construction work includes a cushion section which fits over the knee. A knee cup of rigid plastic is attached to the cushion section by stitching. The rigid knee cup allows the user to move around easily by swiveling and sliding on the knees. The rigid knee cup is particularly useful on floors with tile, cement, or carpeted surfaces. The cushion section typically includes a foam pad to cushion the knee and the knee cup.

The rigid plastic knee cup is very useful in some situations, but has several disadvantages. Some surfaces, such as wood flooring, are scratched by the rigid plastic. For these surfaces, expensive specialty knee pads must be used. The smooth shell of the rigid plastic knee cup makes it unsuitable for roof work and other situations where traction is important.

U.S. Pat. No. 1,792,048 to Swenson discloses a knee protector having two bands of elastic material stitched to a rubber cushioning pad. The length of each band is adjustable by a three-bar fitting.

U.S. Pat. No. 4,872,448 to Johnson, Jr. discloses a knee brace that functions to support and stabilize the patella of the knee. An inflatable U-shaped air cell extends to either side of the patella. The air cell may be inflated by mouth pressure through a tube and valve. The-straps are secured around the leg and the air cell by hook and loop fastener. A backing member of open cell polyurethane foam is located between the knee and the air cell, and has a perforation to permit the crown of the patella to extend through.

U.S. Pat. No. 5,383,843 to Watson et al. teaches an air pressure knee brace apparatus having valve means to allow the user to adjust the desired amount of support pressure. The pneumatic chamber has an aperture located directly over the kneecap. The adjustment straps include buckles to control the tension around the knee. The front of the apparatus is composed of neoprene, while the pneumatic chamber is made of latex rubber.

U.S. Pat. No. 5,500,955 to Gongea discloses a knee pad for athletes which includes a stretchable elastic region connecting the various cushion regions. The fastening strips also attach to the elastic region.

U.S. Pat. No. 5,524,292 to Hargens discloses a knee pad unit having a hard outer plastic shell. Inflatable pneumatic tubes are attached to the shell by VELCRO fasteners. The tubes are inflated by a hand held air pump.

U.S. Pat. No. 5,727,252 to Oetting et al. teaches a knee pad having first and second protective paddings hinged to one another. The paddings are formed of cushioned foam in fabric liners. The straps are secured with hook and loop fasteners and may be composed of elastic. A high impact plastic shell is attached to the front face with hook and loop fastener.

German Patent No. DE 4200056-A1 discloses a knee pad having rubber walls doubled to form a pocket-type hollow cavity containing elastomeric foam.

None of the above inventions and patents, taken either singly or in combination, is seen to describe the instant invention as claimed.

SUMMARY OF THE INVENTION

The present invention is a knee pad for cushioning a human knee. The knee pad includes a cushion section having a fluid-filled chamber. The fluid chamber is filled with a gas, a liquid, a gel, or another fluid. A knee cup is removably attached to the outer layer of the cushion section. The knee cup is interchangeable, so that a knee cup of an appropriate material may be attached for the particular activity the wearer is engaged in. The knee pad is held on the knee by at least one fastening strap. Each fastening strap is removably attached to the cushion section, so that it may easily be replaced when worn out. The invention also includes a knee pad set having two or more interchangeable knee cups for various construction jobs and/or sports.

Accordingly, it is a principal object of the invention to provide a knee pad having a cushion section with a fluid-filled chamber, a removable knee cup, and at least one removable fastening strap.

Another object of the invention is to provide a knee pad having a fluid chamber filled with a gas, a liquid, a gel, or another fluid.

It is another object of the invention to provide a knee pad which is comfortable to wear.

It is a further object of the invention to provide a knee pad which protects the knee while working on the knees.

Still another object of the invention is to provide a knee pad which protects the knee from injury due to falls during athletic activity.

Another object of the invention is to provide a knee pad having interchangeable knee cups so that a knee cup of an appropriate material may be attached for the particular activity the wearer is engaged in.

Another object of the invention is to provide a knee pad having removable fastening straps which can be replaced when worn out or damaged.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
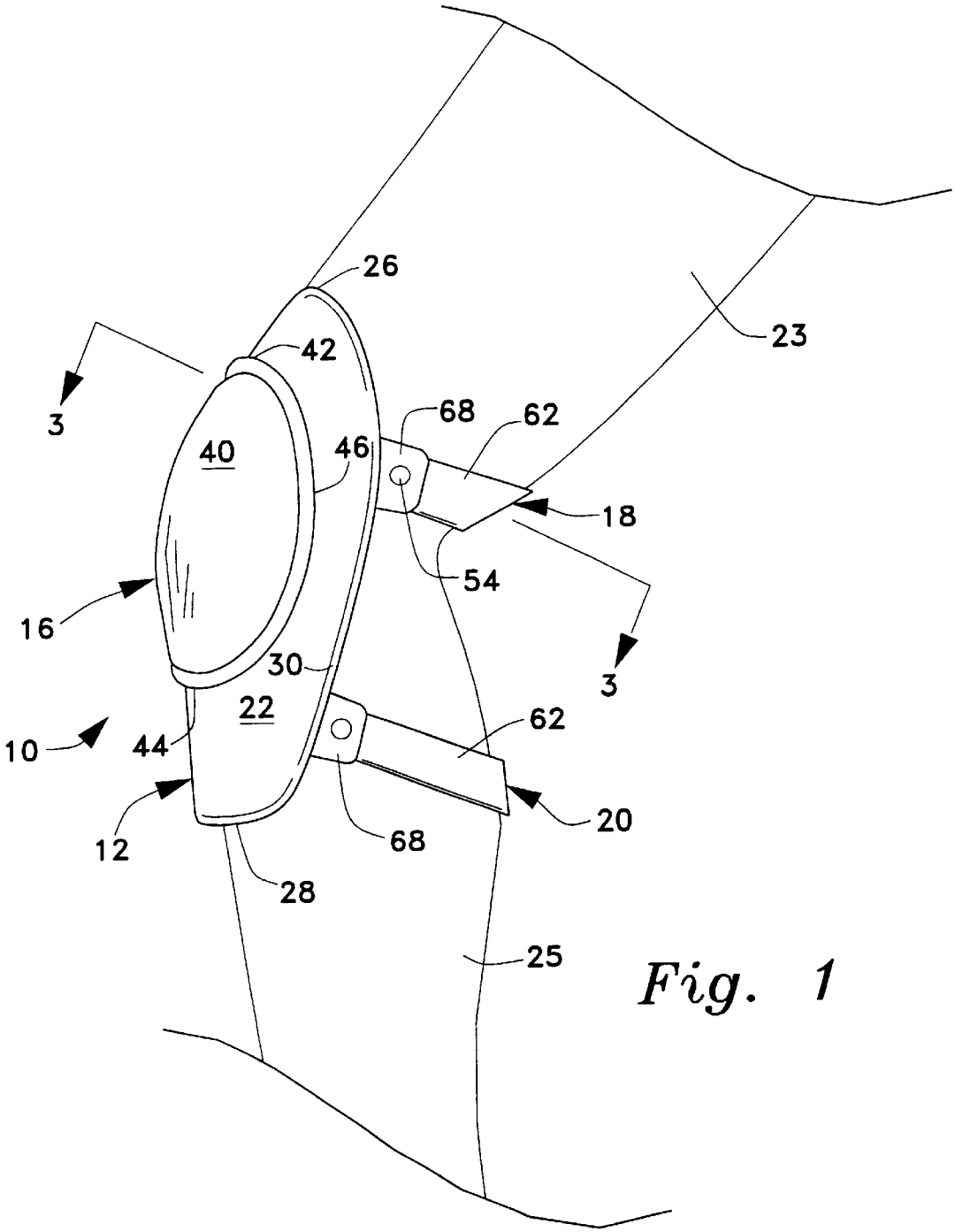
FIG. 1 is an environmental, perspective view of a knee pad according to the present invention.

The present invention is a knee pad 10 for cushioning a human knee. The knee pad 10 includes a cushion section 12 having a fluid-filled chamber 14. The fluid chamber 14 may be filled with a gas, a liquid, a gel, or another fluid. An interchangeable knee cup 16 is removably attached to the cushion section 12. The knee pad 10 is held on the knee by at least one fastening strap. Preferably there are two fastening straps 18 and 20, each removably attached to the cushion section 12.

Figure 2:
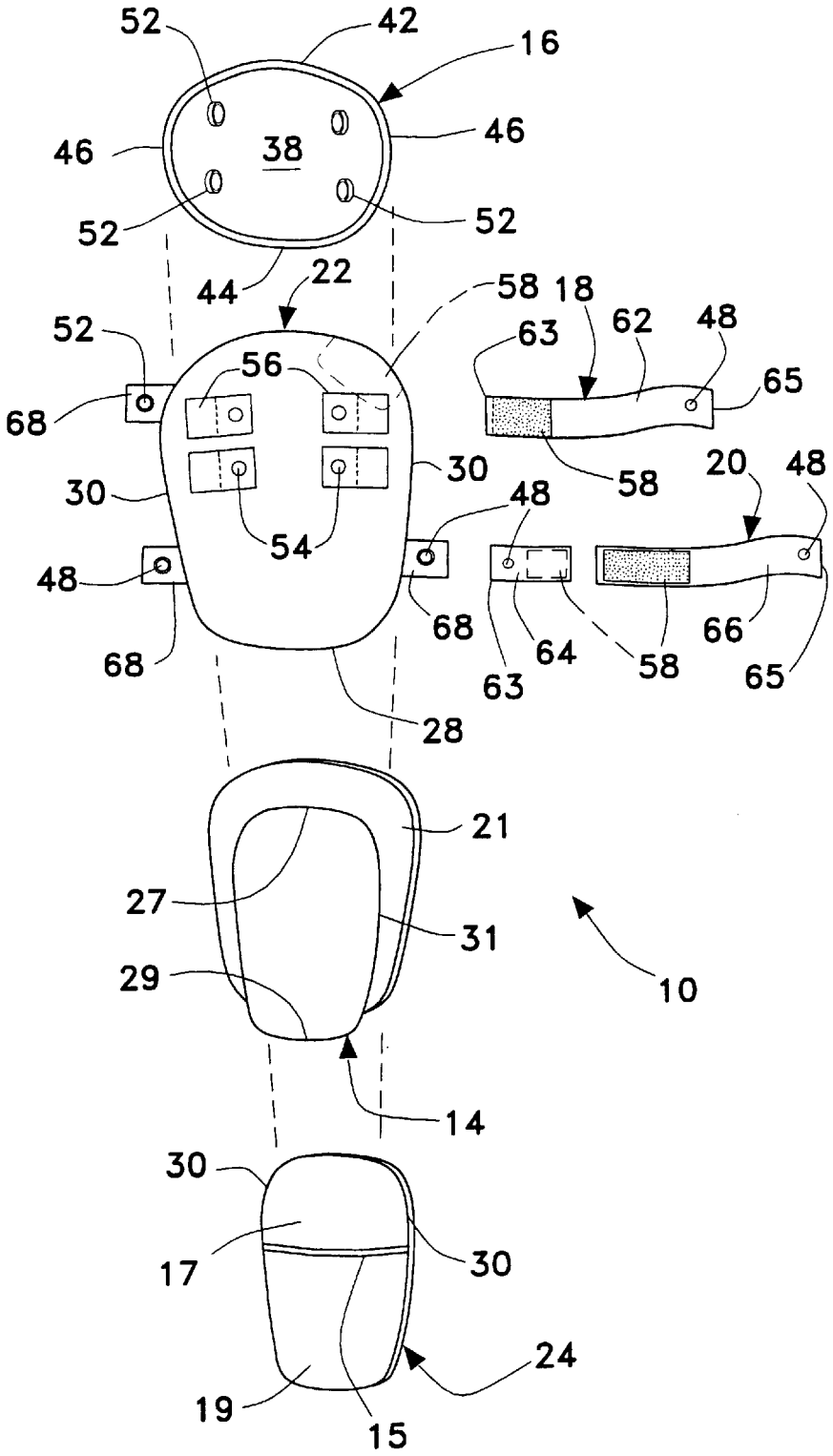
FIG. 2 is an exploded, perspective back view of the knee pad of FIG. 1.
Figure 3:
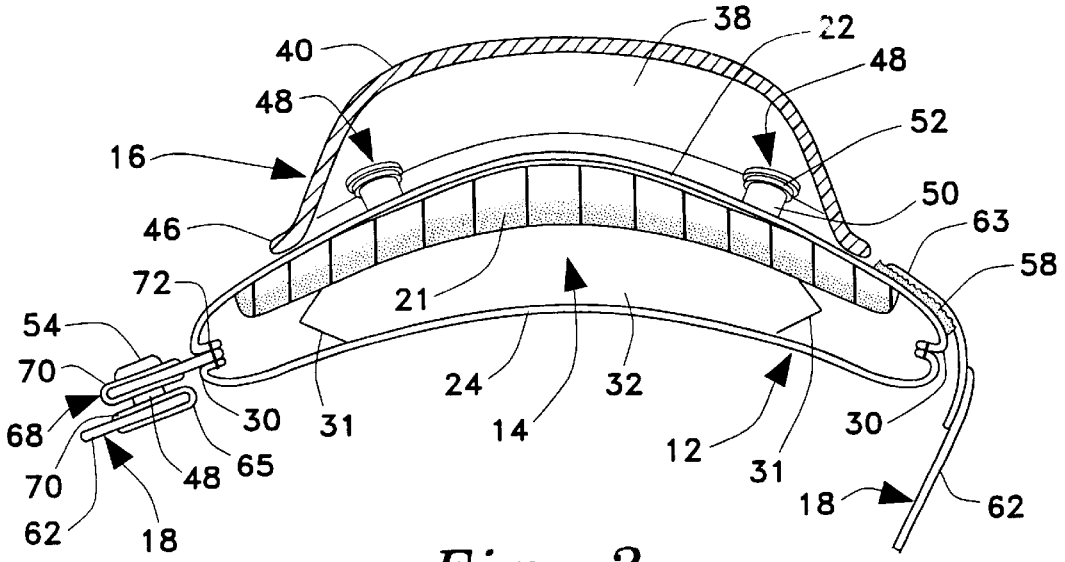
FIG. 3 is a fragmented, cross-sectional view taken along line 3—3 of FIG. 1.

The cushion section 12 includes an outer layer 22 and an opposite inner layer 24, as shown in FIGS. 2 and 3. The cushion section 12 has a shallow U-shape in cross section, as shown in FIG. 3. The inner layer 24 is concave and adapted to contact and cradle the knee and leg for the wearer's comfort. The outer layer 22 is correspondingly convex. See FIGS. 1 and 3.

The outer layer 22 is preferably composed or substantially composed of fabric, ideally high strength nylon or polyamide fabric, such as fabric used in bullet-proof vests. Suitable fabric is any fabric made with or reinforced by an aramid yarn sold under the trademark KEVLAR by DuPont. Any fabric used for the outer layer is preferably a non-absorbent synthetic, or contains a filler which renders the fabric water resistant. A non-absorbent fabric avoids absorption of water when working or playing around spills, leaks, and puddles.

The inner layer 24 may also be composed of fabric, such as a high strength polyamide or nylon fabric, including KEVLAR. A foam-backed fabric may be used for the inner layer 24.

The cushion section 12 has a top edge 26, a bottom edge 28, and two side edges 30. The top and bottom edges 26 and 28 are oriented toward the wearer's upper and lower leg 23 and 25 respectively. Both the top and the bottom edges 26 and 28 are preferably somewhat rounded. The side edges 30 are preferably slightly angled, so that the cushion section 12 is widest near the top edge 26 and tapers gradually towards the bottom edge 28. This shape is comfortable for the wearer and provides good protection to the knee for a variety of activities.

The cushion section 12 may include a foam layer 21 between the fluid chamber 14 and the outer layer 22. The foam layer 21 adds additional cushioning. The foam layer 21 also protects the fluid chamber 14 from puncture by nails, pieces of glass, sharp corners, etc. The foam layer 21 may be thicker where greater pressure is expected, as shown in FIG. 3. Preferably the foam layer 21 has a uniform thickness, as shown in FIG. 2. The thickness is preferably less than ½ inch, most preferably about ¼ inch. Preferably the foam layer 21 extends the full width and length of the cushion section 12. The foam layer 21 may be composed of styrofoam, polyethylene foam, polyolefin foam, or similar foams of synthetic resins. A closed cell foam is preferred for extra durability and to avoid absorption of water.

The various parts of the cushion section 12, including the outer 22, inner 24, and foam layers 21 and the fluid chamber 14, may be fixedly attached to each other. However, the inner layer 24 ideally is composed of two separate sections 17 and 19. The sections overlap, leaving an open slit 15 between them. The slit 15 provides access to the fluid chamber 14 and the foam layer 21. The fluid chamber 14 and the foam layer 21 can be removed, inspected, and replaced if necessary.

The fluid chamber 14 preferably has a shape generally similar to that of the cushion section 12 as a whole, and includes rounded top and bottom edges 27 and 29 and tapering side edges 31. Ideally the fluid chamber 14 extends substantially the full width and length of the cushion section 12. However, if desired the fluid chamber 14 may extend to cover only the knee area, which is subject to the most pressure.

The fluid chamber 14 is located between the outer and inner layers 22 and 24, as shown in FIGS. 2 and 3. The fluid chamber 14 may be adjacent to the outer 22 and inner 24 layers, or one or more protective layers may surround the fluid chamber 14. The fluid chamber 14 is preferably composed of puncture-resistant, flexible rubber or plastic. A thick, flexible rubber or polyvinyl chloride is acceptable. A sturdy material is required to withstand the high pressures created in the fluid chamber 14 when a person works or falls on the knees. The rubber or plastic may be heat sealed around the peripheral edge.

The fluid chamber 14 contains a fluid 32. The fluid may be a liquid or a gas. Suitable gases for the fluid 32 include air and nitrogen. The liquid may be a free-flowing liquid, such as water, or a semiliquid gel. The fluid 32 may also be a sand or powder chosen for its ability to flow freely and absorb shock. The fluid chamber 14 may be filled with fluid 32 by the manufacturer and sealed to prevent escape of the fluid 32, as in FIG. 2.

The fluid chamber 14 may contain partitions 33 and sealing points 41. The partitions 33 represent walls within the chamber 14 which restrict or redirect the flow of fluid in the chamber 14. The sealing points 41 represent points or small areas where the walls of the fluid chamber are bonded to each other by adhesive, by thermal or ultrasonic welding, or other means. Together, the partitions 33 and the sealing points 41 prevent the walls of the fluid chamber 14 from distending too much from pressure caused by the fluid. They also equalize the fluid distribution and allow the fluid chamber 14 to bend more easily and conform to the contour and movement of the knee. See FIG. 5.

Figure 7:
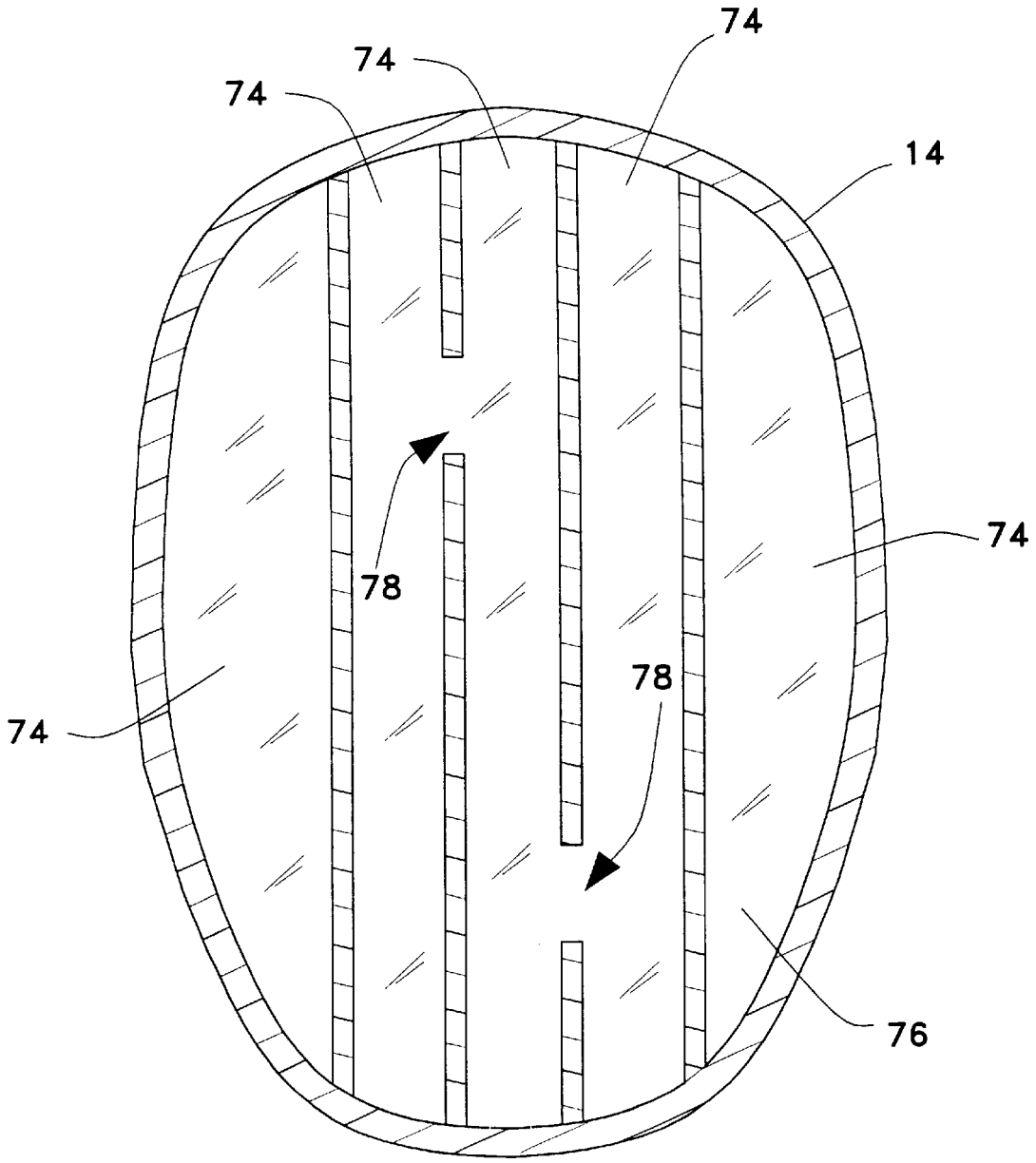
FIG. 7 shows a sectional view of an alternative embodiment of a fluid chamber for a knee pad according to the present invention.
Figure 8:
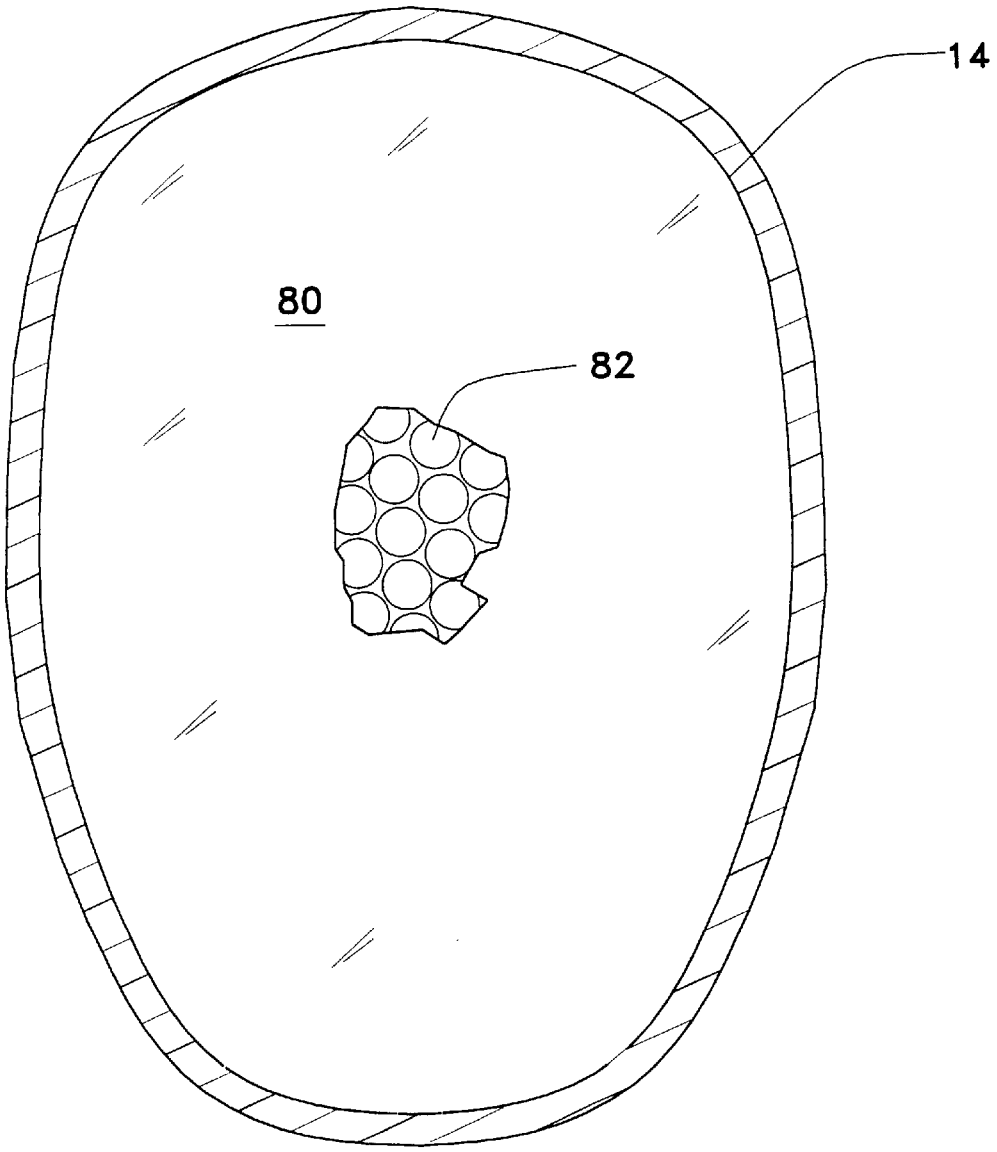
FIG. 8 shows a front view of another alternative embodiment of a fluid chamber for a knee pad according to the present invention with parts broken away to show the interior of the chamber.

As shown in FIG. 7, the fluid chamber 14 may comprise a plurality of fluid compartments 74. The fluid compartments 74 may be completely sealed off from each other by partition walls 76, or the compartments 74 may be connected to each other by ports 78 defined in the partition walls. Hence, the fluid chamber 14 may comprise (1) a single, homogenous bladder without partitions 33 or sealing points 41 to restrict or redirect the flow of fluid; (2) a single, homogenous bladder with partitions 33 or sealing points 41 to restrict or redirect the flow of fluid; (3) a plurality of compartments 74 divided by partition walls 76, but in fluid communication with each other through ports 78; (4) a plurality of compartments 74 divided by partition walls 76 and not in fluid communication with each other; or (5) a combination of (2), (3) and/or (4). In the event that the chamber has multiple compartments 74, the compartments 74 may be arranged in any desired shape or pattern, i.e., honeycombed, parallel elongated cylinders, concentric toroids of varying diameter, etc. In a further variation, shown in FIG. 8, the fluid chamber 14 may comprise a bladder 80 containing a plurality of fluid filled balls or spheres 82. The various configurations shown by dividing the fluid chamber 14 into multiple compartments 74 or by providing a plurality of fluid filled spheres 82 have the advantage of providing different compression or cushioning patterns in response to different pressures applied by the knee, and in providing a delayed compression response in comparison to a single homogenous bladder, thereby providing a smoother cushioning response.

In a preferred embodiment, the fluid 32 is air and the cushion section 12 includes inflation means and deflation means. The inflation means adds air to the fluid chamber, increasing the pressure inside. The deflation means removes the air from the fluid chamber 14, decreasing the pressure.

The inflation means produces an air pressure within the fluid chamber 14 high enough to provide the desired cushioning. Ideally the pressure is high enough to prevent the knee from bottoming out, even under the maximum stress encountered in the activity the wearer is engaged in. The optimal pressure depends on the size and construction of the fluid chamber, the particular activity, and the wearer's preferences. The ability to select a desired amount of cushioning is beneficial for wearers who participate in a wide variety of activities.

Figure 5:
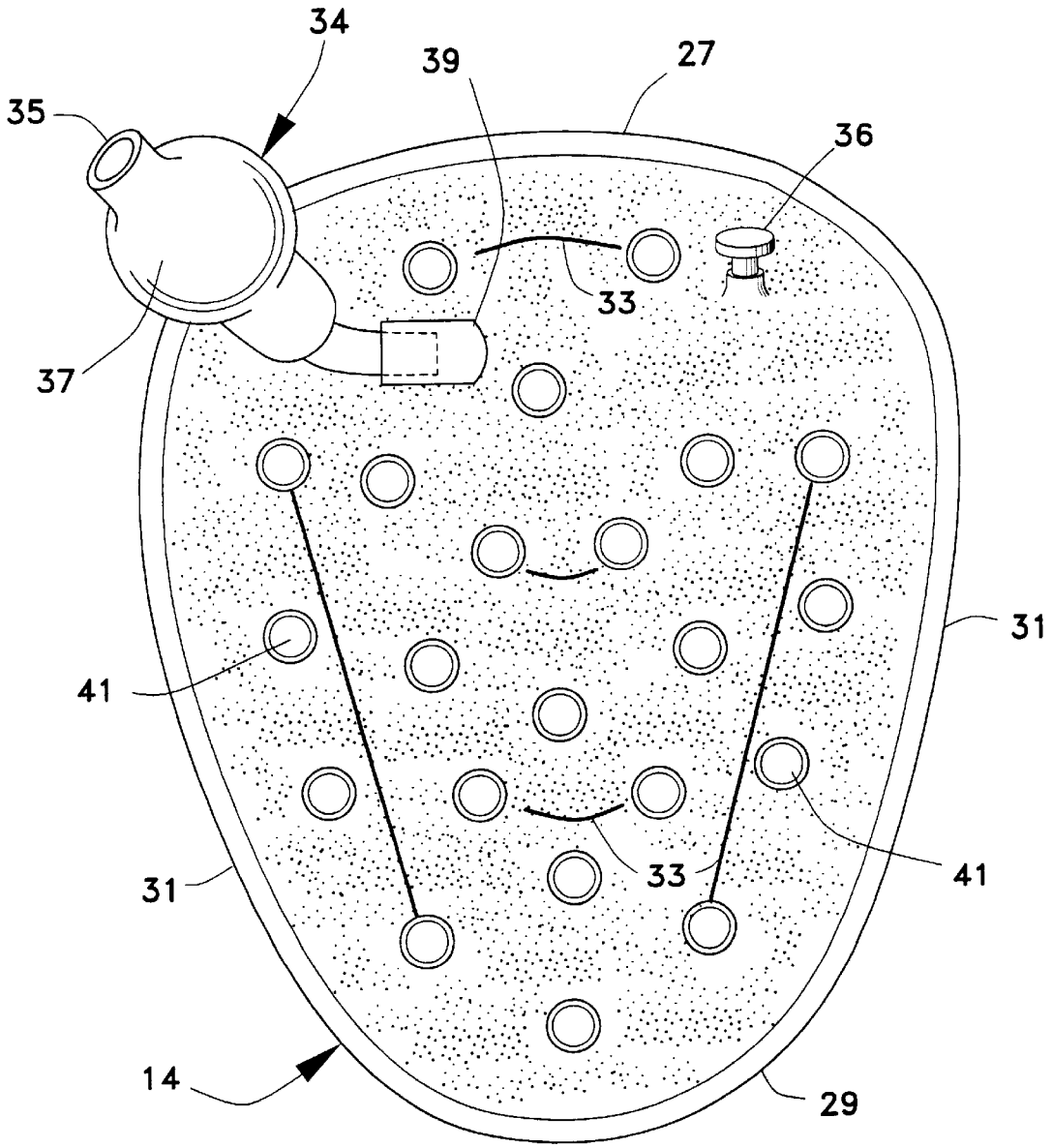
FIG. 5 is a detail view of a fluid chamber having an attached pump and a pressure release valve.

The preferred inflation means is a pump 34 incorporated into the fluid chamber 14, as shown in FIG. 5. The pump 34 preferably includes an inflow check valve 35, an elastic chamber 37, and an outflow check valve 39. See FIG. 5. The elastic chamber 37 is composed of rubber or similar elastic material. The outflow check valve 39 is in fluid communication with the elastic chamber 37 and the interior of the fluid chamber 14. As the wearer manually compresses the elastic chamber 37, air is forced through the outflow check valve 39 into the fluid chamber 14. The inflow check valve 35 is in fluid communication with the elastic chamber 37 and the outside air. When the elastic chamber 37 is released from compression, air is drawn in through the inflow check valve 35 to refill the elastic chamber 37. The inflow 35 and outflow 39 check valves may be composed of metal or plastic.

The capacity of the elastic chamber 37 is preferably between one-fifth and one-tenth of the capacity of the fluid chamber 14. If the capacity of the elastic chamber 37 is too small, a long period of pumping will be required to properly pressurize the fluid chamber 14. An overly large elastic chamber 37 is difficult to compress, is bulky and heavy, and may interfere with the wearer's comfort.

If present, the pump 34 is preferable located near one of the top, bottom, or side edges 27, 29, or 31 of the fluid chamber 14. This peripheral location keeps the pump 34 and its mechanism away from any possible contact with the knee. The elastic chamber 37 is also protected from accidental compression. Optimally the pump 34 is located at one of the top corners, near the top edge 27 and one of the side edges 31 of the fluid chamber. Ideally the pump itself is located between the outer 22 and inner 24 layers of the cushion section 12, with only the inflow check valve 35 exposed.

A mouth valve or a stem valve may also be part of the inflation means. A mouth valve is inexpensive and lightweight, but can be unpleasant to use. The air pressure that can be obtained with a mouth valve is limited. A stem valve, such as found in innertubes, can be used for inflation with a hand pump such as a bicycle pump. Compressed air available at a service station or from a compressor is also suitable for inflating through a stem valve. A separate pump or compressor allows much greater pressures and faster inflation. Unfortunately, a hand pump, service station, or the like may not be available at the moment when inflation is wanted.

The deflation means is preferably a pressure release valve 36. Any type of valve may be used. The valve 36 may have a coil spring biasing the valve in a closed position, which releases air when the spring is compressed by the wearer. A pinch valve is also suitable.

The knee pad 10 includes at least: one knee cup 16, and preferably has two or more knee cups suited for different activities. Each knee cup 16 has an inner surface 38 and an outer surface 40. The inner surface 38 is concave to cradle the knee, as shown in FIGS. 2 and 3. The outer surface 40 is correspondingly convex. See FIGS. 1 and 3. Each knee cup 16 has a top edge 42, a bottom edge 44, and two side edges 46.

Each knee cup 16 has a cup attaching means for removably attaching the inner surface 38 of the knee cup to the outer layer 22 of the cushion section 12. The cup attaching means may be hook and loop fastener. Preferably the cup attaching means is two or more snap fasteners 48, most preferably four snap fasteners. Each snap fastener 48 has a male portion 50 and a female portion 52. See FIG. 3. One of the male and female portions 50 or 52 of each snap fastener 48 is attached to the inner surface 38 of the knee cup 16 near one of the side edges 46 of the knee cup 16. The mating portion of each snap fastener 48 is attached to the outer layer 22 of the cushion section 12. For example, the inner surface 38 of the knee cup 16 may have the female portions 52 of the snap fasteners 48, while the outer layer 22 has the male portions 50.

Snap fasteners provide a solid attachment of the knee cup 16 to the outer layer 22 with no tendency to slip off or move around while being worn. Heavy-duty metal snap fasteners are preferred. Four or more snap fasteners 48 limit motion of the knee cup 16 with respect to the cushion portion 12 in all directions, and also provides redundancy for an extra-secure attachment. Preferably there are no more than eight snap fasteners 48. The pressure of the knee helps to hold the snap fasteners 48 together when the knee pad 10 is worn. The snap fasteners 48 are easy to separate for interchanging knee cups 16.

The mating portions of the snap fasteners 48 may be attached by an adhesive or by a backing rivet 54. A backing rivet is preferred for attachment to the outer layer 22 of the cushion section 12, as this is generally composed of fabric. Adhesive is preferred for attachment of the snap fastener 48 portion to the inner surface 38 of a rigid knee cup 16.

A small strip 56 of rubber, fabric or similar materials may be attached to the backing rivet 54 and fold into a U-shape over the backing rivet 54. See FIG. 2. The strip 56 reinforces the outer layer 22 to protect the snap fastener 48 from tearing out. The strip 56 also prevents the fluid chamber 14 from contacting the backing rivet 54, preventing damage to the fluid chamber 14. Such protection is particularly important when there is no foam layer 21 to protect the fluid chamber 14. If the outer layer 22 is of ballistic nylon, reinforcement is generally not be necessary.

Figure 9:
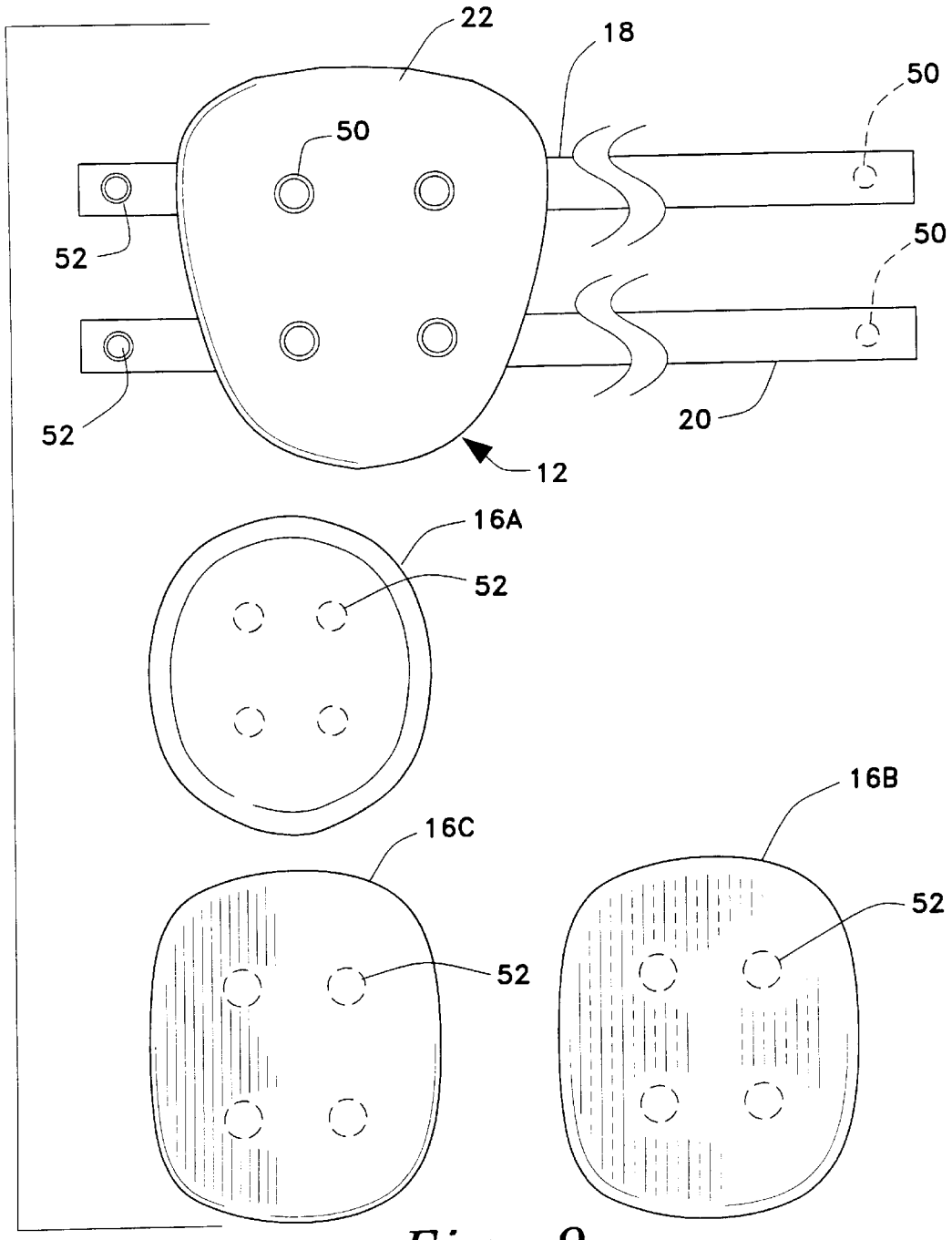
FIG. 9 shows a front view of a knee pad kit according to the present invention.

The invention includes a knee pad set, shown in FIG. 9, containing two or more different, interchangeable knee cups 16. Preferably at least one of the knee cups 16A is composed or substantially composed of a rigid plastic. The rigid plastic knee cup 16A typically has a generally oval cup shape and is sized to cover only the knee area, which is subject to the greatest pressure. Due to lack of flexibility, a rigid knee cup 16 extending beyond this area is often uncomfortable to wear. The rigid plastic knee cup 16A preferably has four snap fasteners 48 attached. Each snap fastener 48 is located at one of the corners, near the top or the bottom edge 42 or 44 and also near one of the side edges 46. Including a rigid plastic knee cup 16A in a set makes the knee pad 10 comfortable for construction work on several types of floors, including cement, carpet, and tile. A rigid plastic knee cup 16A is also suitable for some athletic activities where sliding on the knees is acceptable or desirable. The knee pad set may include two different rigid plastic knee cups 16A, such as one suited for construction work and a different one suited for athletic activities.

The knee pad set may include a knee cup 16B composed or substantially composed of leather. A leather knee cup 16B makes the knee pad 10 suitable for working on wood floors and other delicate surfaces. The knee cup 16B can be replaced when worn out or damaged, avoiding the expense of replacing the entire knee pad 10. The leather knee cup 16B preferably has a shape similar to the cushion section 12 and has about the same shape, length, and width as the cushion section 12. This arrangement prevents the outer layer 22 of the cushion section 12 from contacting the surface being worked on. The leather knee cup 16B has snap fastener 48 portions attached to its inner surface 38 in locations corresponding to those on the outer layer 22. The snap fasteners 48 do not protrude through to the outer surface 40 of the leather knee cup 16B, to avoid scratching the surface being worked on. The leather knee cup 16B may include additional snap fastener 48 portions near its periphery. Additional snap fasteners 48 may be desirable to prevent the edges of a large knee cup 16B from flopping. The corresponding snap fastener 48 portions on the outer layer 22 would be used only for fastening large knee cups 16, and would be unused at other times.

The knee pad set may include a rubber knee cup 16C. The rubber knee cup 16C provides extra traction for working on roofs and the like. Some workers also prefer the traction rubber provides for working on floor surfaces such as tile or linoleum. The rubber may have treads or studs to further increase traction. The rubber knee cup 16C may be sized to cover only the knee area, or may extend the full length and width of the cushion section 12. The rubber knee cup 16C is inexpensive. The rubber knee cup 16C is therefore useful for working on some delicate surfaces when there is a chance that an expensive leather knee cup 16B might be damaged. Rubber also provides excellent traction on wet surfaces.

The knee cup 16 may be removed and the knee pad 10 used alone for some activities. This arrangement provides more traction than a rigid plastic knee cup 16, and avoids the expense of a specialized knee cup 16 for roof work and the like. The high strength synthetic material of the outer layer 22 is lightweight, provides sufficient traction for most purposes, and is resistant to wear from rough shingles.

Specialized knee cups 16 may be provided for use in particular sports or hobbies. Knee cups 16 adapted to wear for racquetball, skateboarding, in-line skating, soccer, baseball, motorcycle riding, etc., may be part of a knee pad set. A knee cup 16 for gardening is another possibility.

Each of the fastening straps 18 and 20 is removably attached to the cushion section 12. Two fastening straps are preferred because of the instability associated with a single fastening strap. A strap attachment means removably attaches each strap to the cushion section 12.

Figure 4:
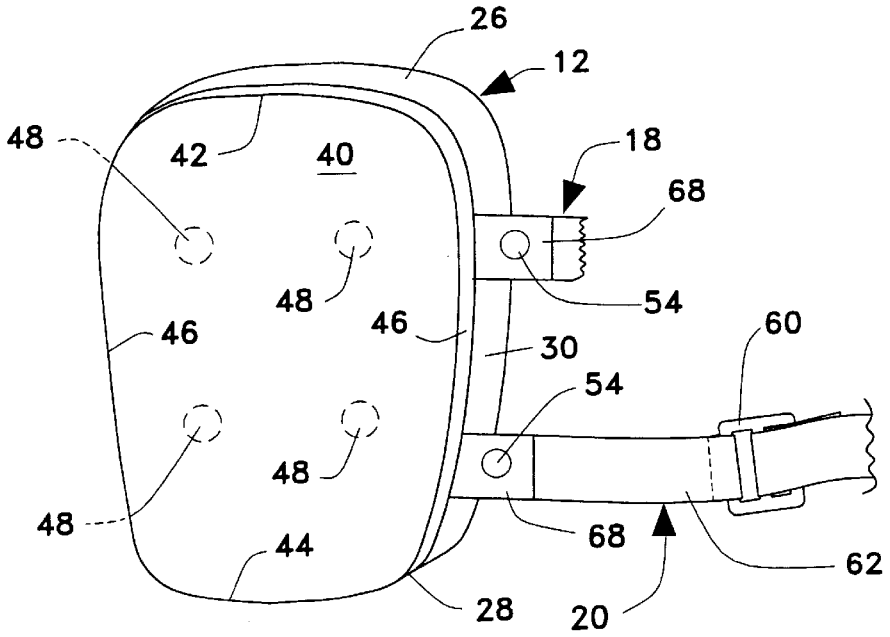
FIG. 4 is a fragmented, perspective view of a knee pad having a knee cup covering substantially the entire outer layer of the cushion section.

Each fastening strap 18 or 20 also has an adjustment means for adjusting the length of the fastening strap to assure proper fit. Preferably each fastening strap includes at least some elastic material, making adjustment easier. However, elastic alone generally does not provide enough length adjustment to fit the range of sizes typically found among wearers. An additional adjustment means is therefore preferred. This may include hook and loop fastener portions 58 on each strap, as shown in FIGS. 2 and 3. A metal or plastic buckle 60 may be used for the length adjustment, as shown in FIG. 4. A system of hooks and eyes is also suitable.

FIG. 2 shows two possible arrangements of the fastening straps. Each strap 18 and 20 has a removable central section 62. Each central section 62 has a first end 63 and a second end 65. Each end 63 and 65 may have a reinforcing strip 70 of rubber or fabric, if desired. See FIG. 3. The preferred arrangement, shown for strap 18 in FIG. 2, has a single central section 62. This limits the number of pieces required and reduces the possibility of losing part of the strap. In an alternative arrangement, strap 20 may have a central section having a first part 64 and a separate second part 66. For either embodiment, the central section 62 preferably is substantially composed of elastic material.

The strap attachment means may include one or more fastening flaps 68. See FIGS. 2 and 3. Each fastening flap 68 is attached to one of the side edges 30 of the cushion section. Each fastening flap 68 is preferably composed of elastic material surrounded by a U-shaped reinforcing strip 70 of rubber or fabric. The elastic material may be attached to the side edge 30 of the cushion section 12 by stitching 72 between the outer layer 22 and the inner layer 24, as shown in FIG. 3. The ends of each fastening strap 18 and 20 may attach to the side edges 30 of the cushion section 12 by a snap fastener 48. One of the mating portions of a snap fastener 48 may be located on the fastening flap 68 and the other on the end 63 or 65 of the fastening strap 18 or 20 to which it attaches. See FIG. 3. In a preferred embodiment, the male portion 50 of the snap fastener 48 is attached to the end 63 or 65, and the female portion 52 is attached to the fastening flap 68.

Several alternative strap attachment means may be used. For example, the ends 63 or 65 may attach by a snap fastener 48 to the outer layer 22 of the cushion section 12. Alternatively, the outer layer 22 of the cushion section 12 may include one portion of hook and loop fastener 58, with the mating portion located on the corresponding end of the central section 62. This arrangement allows the same hook and loop fastener 58 to serve as both the strap attaching means and as the length adjustment means. See FIGS. 2 and 3 for end 63 of strap 18.

The first part 64 and the second part 66 of the central section 62 may include mating portions of hook and loop fastener 58, as shown for strap 20 in FIG. 2. The length of the strap 20 is then adjusted by the hook and loop fastener 58, while the ends 63 and 65 are each attached by a snap fastener 48 to the cushion section 12.

Figure 6:
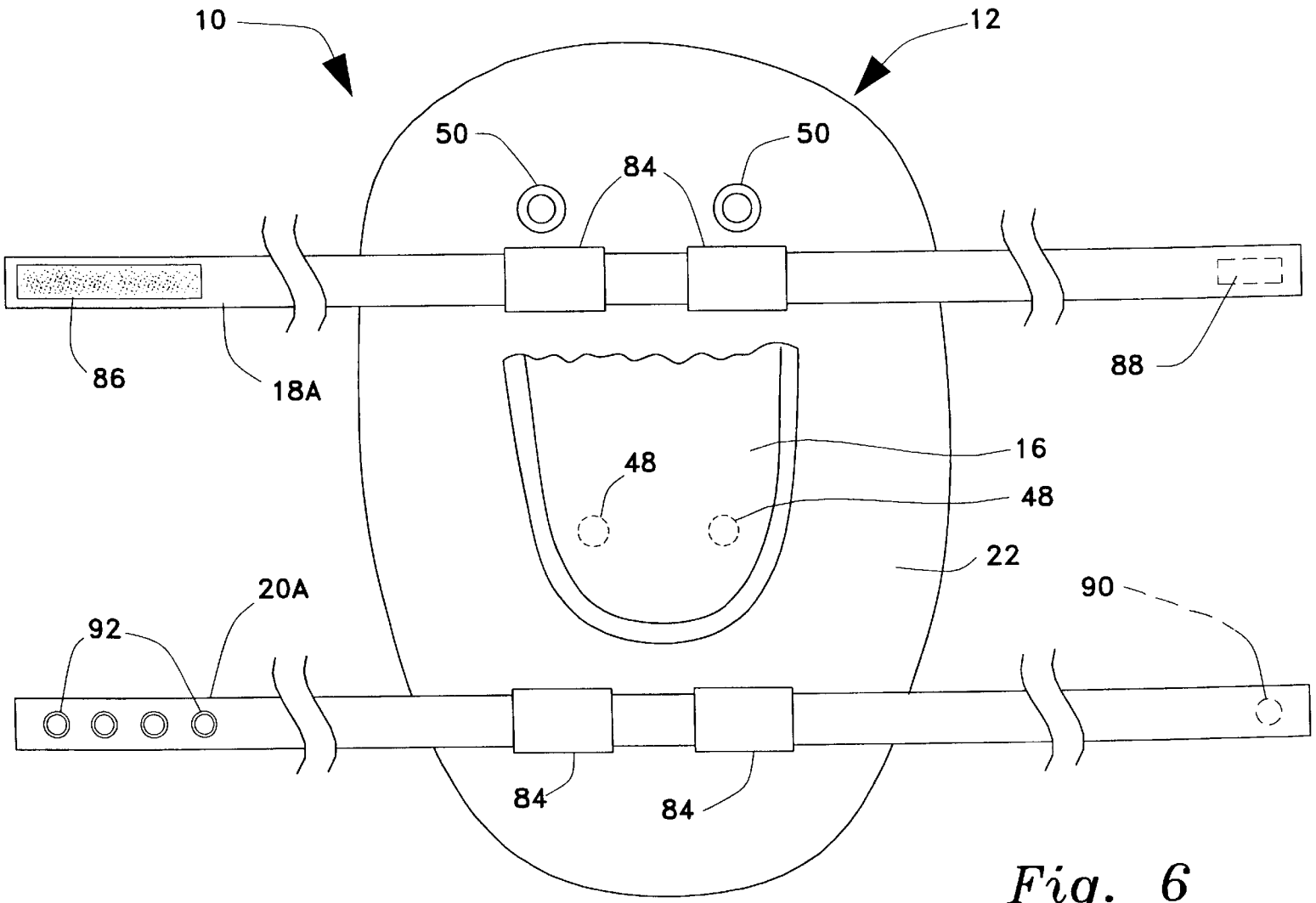
FIG. 6 shows a front view of an alternative embodiment of a knee pad according to the present invention with the knee cup broken away to show a one piece strap.

Still another alternative for providing the knee pad 10 of the present invention with removable fastener straps which are also adjustable in length is shown in FIG. 6. In this embodiment, the straps 18A and 20A each comprise a single elongated strap having a first end and a second end, each strap completely encircling the wearer's leg and being secured to the leg by fastening the first end to the second end. The straps 18A and 20A may be removably attached to the cushion section 12 by inserting the strap 18A or 20A through one or more loops or sleeves 84 on the outer layer 22 of the cushion section 22. The ends of the straps 18A and 20B may be fastened by any conventional fastening means. In the example shown, one end of strap 18A has a first strip of hook and loop material 86 attached thereto, and the second end has a second, mating strip of hook and loop material 88 attached thereto. Length adjustment is made possible by making the first strip 86 longer than the second strip 88. Snap fasteners may also be used. One end of strap 20B has a male snap fastener 90 attached thereto. Length adjustment is accomplished by providing the other end of strap 20B with a plurality of female snap fasteners 92 arranged longitudinally along the end of strap 20B. Still another fastening means may be a buckle 60 (shown in FIG. 4) attached to one end of the strap 18A or 20A, and slidably receiving the other end of the strap 18A or 20A. Other fastening means for joining one end of a strap to another are well known. Each strap 18A and 20A may be made from an elastic material, or the straps 18A and 20A may be made from a relatively inelastic material, such as nylon webbing, leather, etc.

The removable fastening straps 18 and 20 allow the straps to be replaced as necessary. The straps 18 and 20 tend to be the first part of a knee pad 10 to wear out. Replaceable fastening straps are particularly important when the straps are made of an elastic material. Elastic material is desirable in straps because of its comfortable fit. Unfortunately, elastic material tends to lose its elasticity after only a few months of use. This problem can render a relatively new knee pad 10 useless. Replaceable fastening straps significantly extend the usable life of a knee pad 10.

The combination of a cushion section 12 having a fluid-filled chamber 14, interchangeable knee cups 16, and removable fastening straps 18 and 20 provides a remarkably comfortable, durable and versatile knee pad 10. It can be used for working on the knees in a wide variety of situations. The same knee pad 10 can be used for sports, or for several different sports, by attaching appropriate knee cups 16. The expense of buying several different knee pads for different activities is avoided. The knee cups 16 and straps 18 and 20, which are subject to the most wear, can be replaced whenever necessary for a relatively low cost.

It is to be understood that the present invention is not limited to the sole embodiments described above, but encompasses any and all embodiments within the scope of the following claims.

I claim:

1. A knee pad for cushioning a human knee, the knee pad comprising:

(a) a cushion section having a fluid chamber, an outer layer, and an inner layer, the fluid chamber being located between the outer and inner layers, the fluid chamber containing air, the inner layer being adapted to contact the knee;

(b) a knee cup removably attached to said cushion section;

(c) at least one fastening strap removably attached to said cushion section, the fastening strap being for fastening the knee pad to a human knee; and (d) said cushion section further including inflation means for adding the air to the fluid chamber and deflation means for removing the air from the fluid chamber.

2. The knee pad according to claim 1, wherein the fluid chamber is sealed to prevent escape of the air.

3. The knee pad according to claim 1, wherein the fluid chamber includes a pump and a pressure release valve.

4. The knee pad according to claim 3, wherein the fluid chamber has a top edge and two side edges, and the pump is located near the top edge and one of the side edges of the fluid chamber.

5. The knee pad according to claim 1, further comprising a plurality of snap fasteners, each snap fastener having a male portion and a mating female portion, one of the male portion and the female portions being fixedly attached to an inner surface of said knee cup adjacent a side edge of said knee cup, and the other portion of said snap fastener being fixedly attached to the outer layer of said cushion section.

6. The knee pad according to claim 1, wherein each said at least one fastening strap comprises:

a) an elongated, one-piece strap having a first end and a second end; and b) at least one fastener attached to said fastening strap for releasably attaching the first end to the second end.

7. The knee pad according to claim 1, wherein the outer layer is substantially composed of a high strength synthetic fabric including an aramid yarn.

8. The knee pad according to claim 1, wherein the cushion section further includes a foam layer disposed between said fluid chamber and the outer layer.

9. A knee pad set for cushioning a human knee, the knee pad set comprising:

(a) a cushion section having a fluid chamber, an outer layer, and an inner layer, the fluid chamber being located between the outer and inner layers, the fluid chamber containing a fluid, the inner layer being adapted to contact the knee;

(b) a plurality of interchangeably knee cups removably attached to said cushion section; and (c) two fastening straps removably attached to said cushion section, the fastening straps being for fastening the knee pad to a human knee, each of the fastening straps having an adjustment means for adjusting the length of the fastening strap, each of the fastening straps further having a central section substantially composed of elastic material.

10. The knee pad set according to claim 9, wherein said plurality of knee cups further comprises at least one knee cup made from a rigid plastic material and at least one knee cup made from leather.

11. The knee pad set according to claim 10, wherein said plurality of knee cups further comprises at least one knee cup made from rubber.

12. A knee pad for cushioning a human knee, the knee pad comprising:

(a) a cushion section having a fluid chamber, an outer layer, and an inner layer, the fluid chamber being located between the outer and inner layers, the fluid chamber containing a fluid, the inner layer being adapted to contact the knee;

(b) a knee cup removably attached to said cushion section; and (c) two fastening straps removably attached to said cushion section, the fastening straps being for fastening the knee pad to a human knee, each of the fastening straps having an adjustment means for adjusting the length of the fastening strap, each of the fastening straps further having a central section substantially composed of elastic material.

13. The knee pad according to claim 12, wherein the fluid is selected from the group consisting of liquids and gases.

14. The knee pad according to claim 12, wherein the fluid is a gel.

15. The knee pad according to claim 12, wherein the adjustment means includes at least one mating pair of hook and loop fastening material strips.

16. The knee pad according to claim 12, wherein the adjustment means includes at least one buckle.

17. The knee pad according to claim 12, wherein at least one end of each fastening strap is removably attached to one of the side edges of the cushion section by a snap fastener.

* * * * *